US006183338B1

(12) United States Patent
Mallette

(10) Patent No.: US 6,183,338 B1
(45) **Date of Patent: *Feb. 6, 2001**

(54) PLAYTHING

(76) Inventor: Lorretta M. Mallette, 519 Oak Ridge Dr., Redwood City, CA (US) 94062

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/371,178

(22) Filed: Aug. 10, 1999

(51) Int. Cl.[7] ..... A63H 3/36; A63H 3/12; A63H 3/02

(52) U.S. Cl. ..... 446/337; 446/321; 446/372; 446/391

(58) Field of Search ..... 446/321, 369, 446/371, 337, 372, 384, 385, 391, 394, 395; 40/768, 770, 773, 702

(56) References Cited

U.S. PATENT DOCUMENTS

| | | | | |
|---|---|---|---|---|
| D. 391,519 | | 3/1998 | Silvers | D11/160 |
| D. 398,665 | | 9/1998 | Hughes | D21/168 |
| D. 402,703 | | 12/1998 | Middleton | D21/155 |
| D. 404,776 | | 1/1999 | Fertig | D21/648 |
| 2,199,049 | * | 4/1940 | Greenberg | 446/321 |
| 4,020,586 | | 5/1977 | Brenner | 46/164 |
| 4,573,927 | * | 3/1986 | Newman | 446/321 |
| 4,580,992 | * | 4/1986 | McKay | 446/321 |
| 4,629,441 | | 12/1986 | Cahill | 446/372 |
| 4,773,953 | | 9/1988 | Hare | 156/240 |
| 4,776,823 | * | 10/1988 | Hanlon | 446/321 |
| 4,781,648 | * | 11/1988 | Garfinkel | 446/321 |
| 4,840,603 | | 6/1989 | Cahill | 446/391 |
| 4,929,213 | * | 5/1990 | Morgan | 446/97 |
| 4,993,987 | * | 2/1991 | Hull et al. | 446/268 |
| 5,009,626 | * | 4/1991 | Katz | 446/391 |
| 5,046,985 | | 9/1991 | Cearfoss | 446/321 |
| 5,123,870 | | 6/1992 | Cahill | 446/372 |
| 5,141,466 | * | 8/1992 | Catizone | 446/391 |
| 5,182,844 | | 2/1993 | Honda | 29/469 |
| 5,314,370 | * | 5/1994 | Flint | 446/391 |
| 5,382,187 | * | 1/1995 | Wilson | 446/391 |
| 5,403,224 | * | 4/1995 | Gintling | 446/321 |
| 5,515,592 | * | 5/1996 | Mills | 446/369 |
| 5,676,584 | * | 10/1997 | Perryman | 446/321 |
| 5,842,900 | | 12/1998 | Hodge | 446/73 |
| 5,848,900 | * | 12/1998 | Pearson | 446/321 |
| 5,947,791 | * | 9/1999 | Taylor | 446/321 |

* cited by examiner

*Primary Examiner*—D. Neal Muir
(74) *Attorney, Agent, or Firm*—Michael B. Einschlag

(57) ABSTRACT

An embodiment of the present invention is a plaything that includes: (a) a body; (b) a head attached to the body having a recessed area within the head; and (c) a band at least partially surrounding the recessed area. In a further embodiment, the plaything further comprises an appliance that fits in the recessed area. In a still further embodiment, the appliance is detachably affixed to the recessed area. In a yet still further embodiment, the appliance comprises an image.

10 Claims, 7 Drawing Sheets

PLAYTHING

TECHNICAL FIELD OF THE INVENTION

The present invention pertains to the field of playthings, for example, playthings for children such as dolls, stuffed animals, novelty items, and the like. In particular, the present invention pertains to playthings such as dolls, stuffed animals, novelty items, and the like that have an appliance such as a face which is detachably affixed thereto. In further particular, the present invention pertains to such playthings where the appliance holds or comprises a likeness of, for example, a child.

BACKGROUND OF THE INVENTION

Dolls are well known in the prior art that exhibit changeable facial features. For example, a doll with an envelope for a photo image face is disclosed in U.S. Pat. No. 4,020,586 (Benner) wherein a doll is provided with a pocket located in a facial zone to receive a photographic likeness of a person to personalize the doll.

U.S. Pat. No. 4,929,213 (Morgan) discloses a method of creating images such as the face of a child on flexible foam plastic such as a doll's head. It is further disclosed that the method can also be used to create images of other objects such as pet animals with the head on a separate piece of foam attachable to the body in different tilted positions by means of Velcro.

U.S. Pat. No. 5,403,224 (Gintling) discloses a doll having a pocket secured to a face portion of the doll for displaying a photograph. The doll includes a doll body and a doll head with a pocket which may include a releasable sealing closure such that the photograph may be sealed within the pocket. Releasable fabric fasteners may be utilized to secure the pocket to the face portion, whereby the pocket may be selectively removed to facilitate both a reversing of the pocket and a washing of the doll.

Lastly, U.S. Pat. No. 5,842,900 (Hodge) discloses a stuffed doll or toy that includes a main body section from which a plurality of appendages extend, representative of arms and legs. A displaceable panel or layer is shiftably attached to the fabric of the main body section and may include representations of facial features. Separable fastener elements such as hook and loop components serve to attach the displaceable panel and intermediate layers in a closed position flush with the main body section.

The dolls disclosed in the prior art suffer in that they do not provide a natural appearance of the likeness which is affixed to the doll. As such, a need exists in the art for a plaything such as a doll, a stuffed animal, a novelty item, and the like that can have a likeness of, for example, a child, affixed thereto which provides a natural appearance.

SUMMARY OF THE INVENTION

Embodiments of the present invention advantageously satisfy the above-identified need in the art and provide a plaything that can have a likeness of, for example, a child, affixed thereto which provides a natural appearance. In particular, an embodiment of the present invention is a plaything that comprises: (a) a body; (b) a head attached to the body having a recessed area within the head; and (c) a band at least partially surrounding the recessed area. In a further embodiment, the plaything further comprises an appliance that fits in the recessed area. In a still further embodiment, the appliance is detachably affixed to the recessed area. In a yet still further embodiment, the appliance comprises an image.

DETAILED DESCRIPTION

Embodiments of the present invention include a soft body doll, a stuffed animal, a hard body doll, and a novelty item made with a recessed area that is trimmed with a band that forms a frame around the recessed area. In operation, the band can function as a guide for centering and holding in place an appliance that is inserted into the recessed area. In one embodiment of the present invention, the band is a hard material that encompasses an area that is smaller that a cross sectional area of the appliance that is to be placed into the recessed area. In accordance with this embodiment, the band makes a snug fit with, and assists in holding, the appliance in place. In further embodiments of the present invention, the appliance and the recessed area are configured with attachment mechanisms (to be described in detail below) for detachably affixing the appliance to the recessed area.

Figure 1:
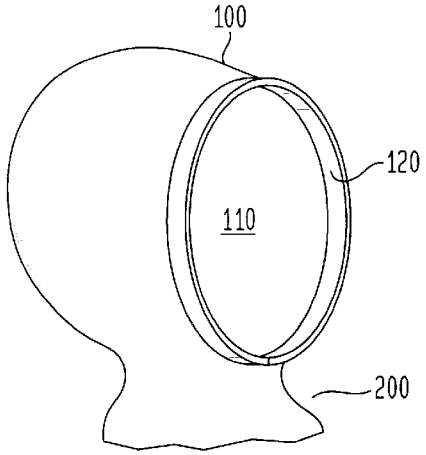
FIGS. 1 and 2 show a pictorial representation of a first and a second perspective view, respectively, of a head of a doll which is fabricated in accordance with the present invention.
Figure 2:
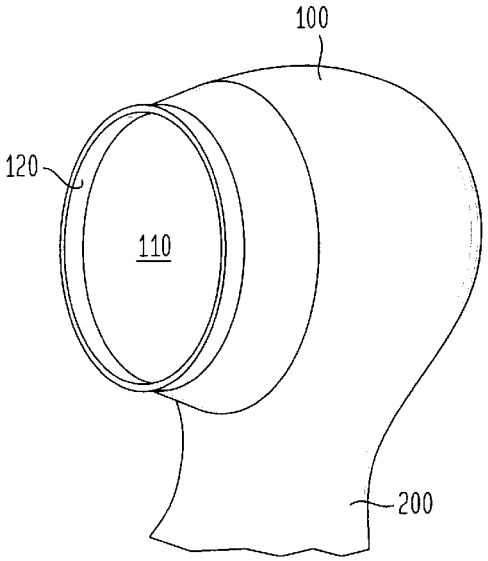

FIGS. 1 and 2 show a pictorial representation of a first and a second perspective view, respectively, of head 100 of doll 200 which is fabricated in accordance with the present invention. As shown in FIGS. 1 and 2, head 100 comprises recessed area 110 which is surrounded by band 120. Although band 120 is shown to surround recessed area 110 completely, the present invention is not thusly limited and includes embodiments where band 120 surrounds a portion of recessed area 110. However, in preferred embodiments of the present invention, band 120 surrounds at least a substantial portion of recessed area 110. Further, although recessed area 110 is shown to be situated in head 100 of doll 200, the present invention is not thusly limited and includes embodiments wherein recessed area 110 is situated in any other area of a doll, a stuffed animal, a novelty item, and the like.

In accordance with the present invention, band 120 could be formed of plastic, wood, metal, rubber, laminates of any of the foregoing (including layers of cloth), and the like. Although band 120 may be comprised of any of the previously defined materials, in a preferred embodiment, band 120 is covered with fabric that matches the fabric of doll 200 so that it may be incorporated into the design of head 100 of doll 200. Further, as should be clear to those of ordinary skill in the art, recessed area 110 on head 100 could be of any circumference, depending on the size of doll 200 one wishes to create. Still further, although the shape of recessed area 110 is shown as an oval, the present invention is not thusly limited and includes embodiments wherein the shape of recessed area 110 is any arbitrary shape.

Figure 3:
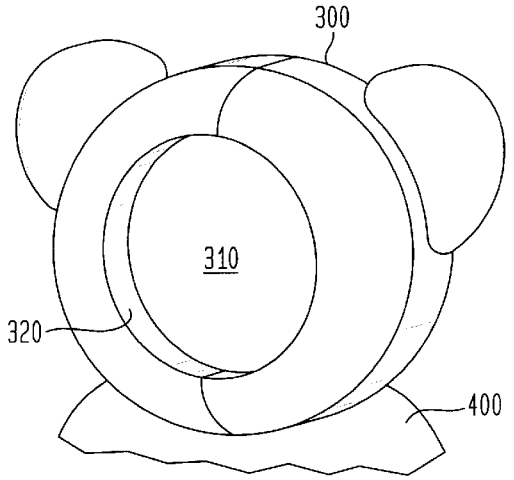
FIG. 3 shows a pictorial representation of a perspective view of a head of another doll which is fabricated in accordance with the present invention.

FIG. 3 shows a pictorial representation of head 300 of stuffed animal 400 which is fabricated in accordance with the present invention. As shown in FIG. 3, head 300 comprises recessed area 310 which is surrounded by band 320. Although band 320 is shown to surround recessed area 310 completely, the present invention is not thusly limited and includes embodiments wherein band 320 surrounds a portion of recessed area 310. However, in preferred embodiments of the present invention, band 320 surrounds at least a substantial portion of recessed area 310. Further, although recessed area 310 is shown to be situated in head 300 of stuffed animal 400, the present invention is not thusly limited and includes embodiments wherein recessed area 310 is situated in any other area of a doll, a stuffed animal, a novelty item, and the like. As shown in FIG. 3, band 320 is covered with furry material that is used to cover the rest of stuffed animal 400.

Figure 4:
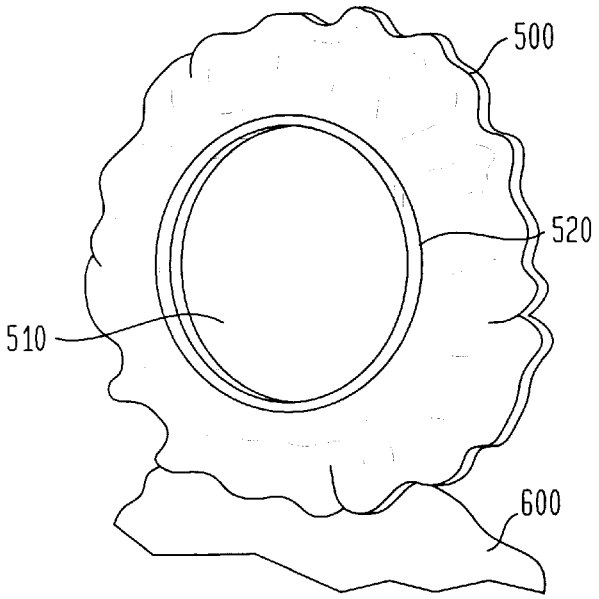
FIG. 4 shows a pictorial representation of a perspective view of a head of still another doll which is fabricated in accordance with the present invention.

FIG. 4 shows a pictorial representation of head 500 of doll 600 which is fabricated in accordance with the present invention. As shown in FIG. 4, head 500 comprises recessed area 510 which is surrounded by band 520. Although band 520 is shown to surround recessed area 510 completely, the present invention is not thusly limited and includes embodiments wherein band 520 surrounds a portion of recessed area 510. However, in preferred embodiments of the present invention, band 520 surrounds at least a substantial portion of recessed area 510. Further, although recessed area 510 is shown to be situated in head 500 of doll 600, the present invention is not thusly limited and includes embodiments wherein recessed area 510 is situated in any other area of a doll, a stuffed animal, a novelty item, and the like. As shown in FIG. 4, band 520 is covered with a frilly material that is used as a decorative aspect of the face area of doll 600.

Figure 5:
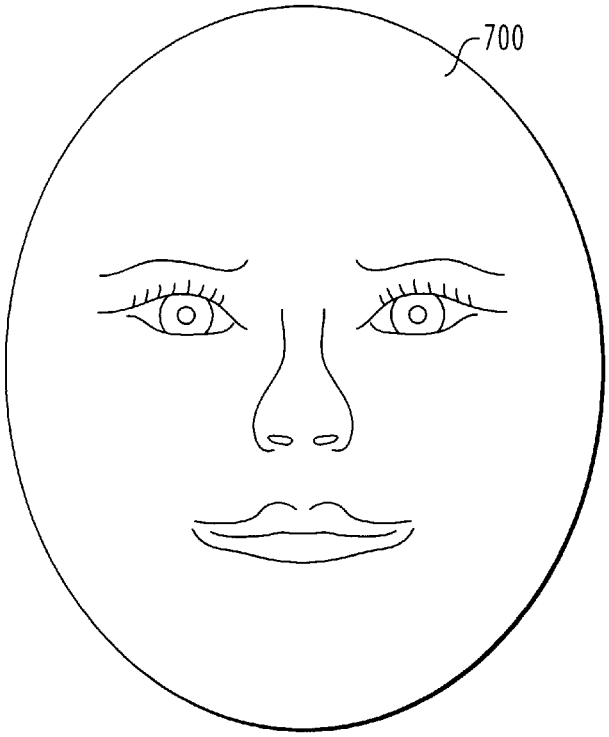
FIG. 5 shows a pictorial representation of a faceplate apparatus used with the embodiments of FIGS. 1 and 3–4 to fabricate playthings in accordance with the present invention.
Figure 6:
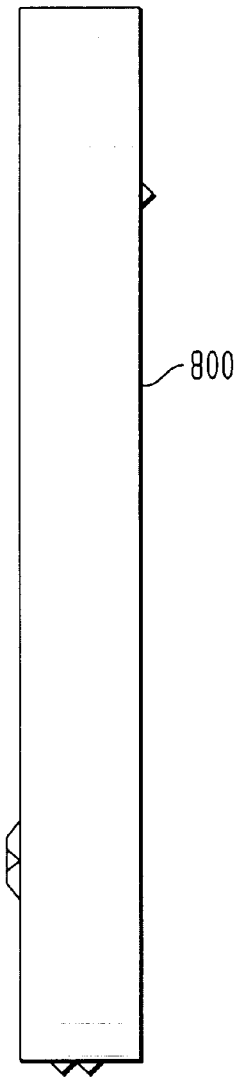
FIGS. 6–24 illustrate steps of a method for fabricating embodiments of the present invention.

FIG. 5 shows appliance 700 that is fabricated in accordance with the present invention. In a preferred embodiment of the present invention, appliance 700 comprises an image, preferably, a photographic image, that is transferred onto appliance 700 in accordance with any one of a number of methods that are well known to those of ordinary skill in the art. In accordance with the preferred embodiment of the present invention, when such an image represents a face, appliance 700 can advantageously serve as a faceplate for doll 200 shown in FIGS. 1 and 2, stuffed animal 400 shown in FIG. 3, and doll 600 shown in FIG. 4. For example, one could: (a) copy or scan a photograph or take a digital image and transfer the image onto heat transfer paper; and (b) transfer the image on the heat transfer paper to fabric which covers at least a portion of the appliance using a heating process. In another method which is well known to those of ordinary skill in the art, an image is scanned or a photograph is taken, for example, with a digital camera, and printed directly onto fabric. As is well known, fabric used for such a process of image transfer could be CANON fabric sheets, as Cotton White, EPSON canvas cloth rolls, and the like. In still another method, an image is directly applied to a backing which forms all of, or a part of, the appliance. In a preferred embodiment, the backing is a stretchable fabric that can lie flat during an image transfer process. Then, removable, shaped inserts comprising (a) soft padding and (b) either foam board or plastic (for stiffness) are added. Finally, a drawstring located around the outer edge of the appliance wraps around the inserts to create a pouch in the shape of the inserts. Advantageously, for this embodiment, the image is transferred to a flat surface that becomes a three dimensional surface upon the addition of the soft and hard inserts.

As one can see from the above, advantageously in accordance with the present invention, recessed area 110 shown in FIGS. 1 and 2, recessed area 310 shown in FIG. 3, and recessed area 510 shown in FIG. 4 enable one to insert faceplate appliance 700 into the doll's or stuffed animal's recessed area.

As one can readily appreciate, whenever faceplate appliance 700 comprises a transferred photograph, the doll, stuffed animal, or novelty item becomes personalized. Advantageously, in accordance with the present invention: (a) there is an improved look over that of the prior art for a dividing line between the image on facial appliance 700 and the doll's, stuffed animal's, or novelty item's fabric and (b) the facial portion of the doll or stuffed animal looks like a part of the doll or stuffed animal rather than appearing to be an attachment or a separate piece as is the case in the prior art.

In accordance with a preferred embodiment of the present invention, band 120 shown in FIGS. 1 and 2, band 320 shown in FIG. 3, and band 520 shown in FIG. 4 encompasses an area that is smaller than a cross sectional area of facial appliance 700 shown in FIG. 5. In accordance with the preferred embodiment, the band makes a snug fit with, and assists in holding, facial appliance 700 in place. Advantageously, in accordance with the present invention, using recessed area 110 shown in FIGS. 1 and 2, recessed area 310 shown in FIG. 3, and recessed area 510 shown in FIG. 4 makes it easier to remove facial appliance 700.

The base of recessed area 110 shown in FIGS. 1 and 2, recessed area 310 shown in FIG. 3, and recessed area 510 shown in FIG. 4 could be made from a variety of fabrics or hard materials. In a preferred embodiment, the recessed area is fabricated to have a substantially flat surface that is situated about one inch (1") below the surface of the head. Some materials that could be used for the surface of the recessed area are headliner, tricot, cotton, Velcro, cardboard, plastic, and rubber.

In accordance with a preferred embodiment of the present invention, recessed area 110 shown in FIGS. 1 and 2, recessed area 310 shown in FIG. 3, and recessed area 510 shown in FIG. 4 and faceplate appliance 700 have attachment mechanisms disposed thereon. Attachment mechanisms could include, without limitation: (a) two sided tape; (b) Velcro matting and Velcro loops (one attached to the recessed area and one attached to the appliance); (c) Velcro Comp (headliner fabric) and Velcro loops (one attached to the recessed area and one attached to the appliance); (d) hook and eyes (one attached to the recessed area and one attached to the appliance); (e) buttons and button holes; (f) suction cups; (g) magnets; (h) magnetized sheeting; (i) zippers disposed about the band and the appliance; (j) screws; (k) light basting; (l) snaps; and (m) fuse with a fusing tape.

In a preferred embodiment of the present invention which comprises a hard bodied doll, such as a rubber or hard plastic doll, faceplate appliance 700 could attach to the recessed area and be surrounded by a band.

Figure 7:
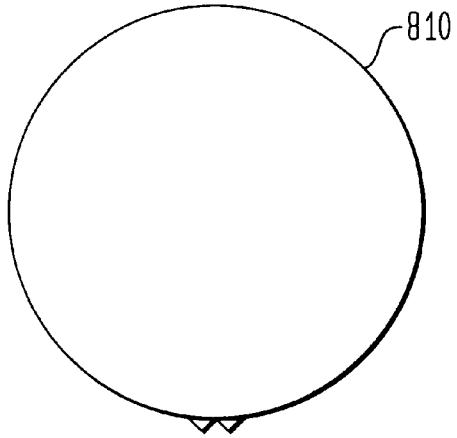
Figure 8:
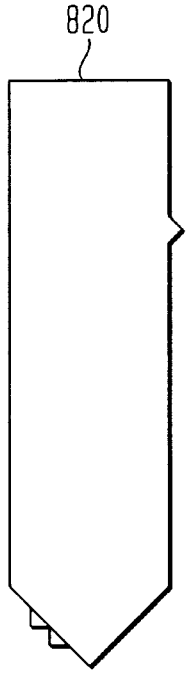
Figure 9:
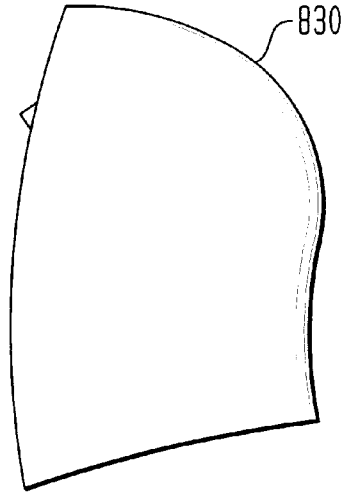
Figure 10:
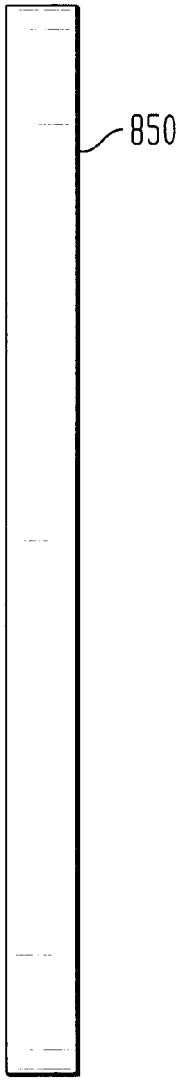

The following describes a method for fabricating a head of a doll or stuffed animal in accordance with the present invention. Using the method described in detail below, one of ordinary skill in the art would attach the head to a body which is fabricated in accordance with any one of a number of methods that are well known to those of ordinary skill in the art. FIGS. 6–10 show pattern pieces used to assemble the head. In accordance with the assembly method, framing bias strip 800 shown in FIG. 6, side-of-head-piece 820 shown in FIG. 8, and back-of-head-piece 830 shown in FIG. 9 are all cut from a fabric desired for use in constructing the doll or stuffed animal. Facial piece 810 shown in FIG. 7 is cut from a fabric similar to tricot or headliner, which fabric is acceptable to adhere to Velcro. Lastly, strip 850 shown in FIG. 10 is a strip of hard rubber or plastic that is about one inch wide (1") and is used to form the frame.

Figure 13:
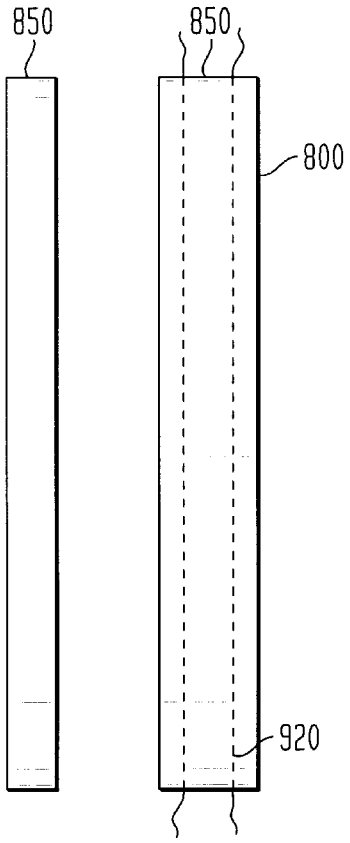

Referring to FIG. 13, to start the assembly, take strip 850 and place it on between two of framing bias strip 800, and stitch the two of framing bias strip 800 using thread 920. As shown in FIG. 13, strip 850 is substantially the same size in length as each of framing bias strip 800.

Figure 14:
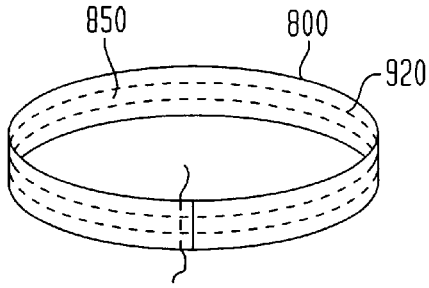

Next, referring to FIG. 14, fold the structure shown in FIG. 13 in half lengthwise, with ends matching, and stitch the ends together. As a result, the two of framing bias strip 800 form a full circle with concealed strip 850 acting as a firm support for this circle, now frame 120 of FIG. 1.

Figure 15:
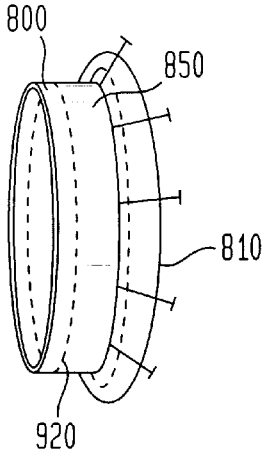
Figure 16:
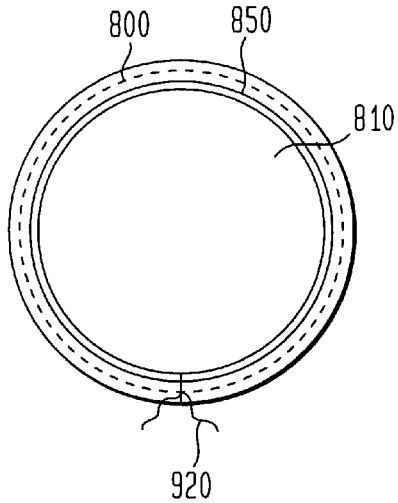

Next, referring to FIGS. 15 and 16, pin facial piece 810 and framing bias strip 800 together on the "face side" of the fabric. To do this, place facial piece 810 on a flat surface, and place framing bias strip 800 onto, and around, facial piece 810. Next, stitch around the outer edge using thread 920 leaving an approximate ¼" seam allowance around the outer edge. Notches on framing bias strip 800 (shown in FIG. 6) are advantageously used to line up framing bias strip 800 and facial piece 810 to enable one to match the seam on framing bias strip 800 and the bottom of facial piece 810 (do not clip the edges). Next, flip framing bias strip 800 inside out, and invert recessed area 110 for the next step.

Figure 17:
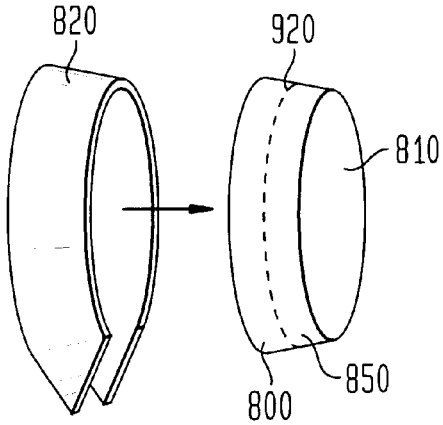

Next, referring to FIG. 17, with "face sides" together (side-of-head-piece 820 and framing bias strip 800), stitch across the bottom of side-of-head-piece 820 at the chin section. Then, with "face sides" together, stitch side-of-head-piece 820 to framing bias strip 800 around the open end. Next, turn this completed section right side out and push the facial area inward with framing bias strip 800. After this, the seam just sewn which attaches side-of-head-piece 820 to framing bias strip 800 is now the seam in front of the face surrounding the frame, and keeps the recessed area in place. One may need to top stitch around the band, but this is not necessary; in practice, this depends upon the fabric used for assembly of the doll or stuffed animal.

Figure 18:
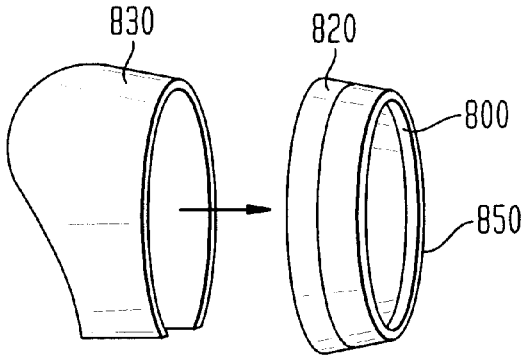

Next, with "face sides" together, stitch the back seam of back-of-head-piece 830, clipping around the curved edges. Then, referring to FIG. 18, with "face sides" of the fabric together, pin and then stitch back-of-head-piece 830 to side-of-head-piece 820, leaving an opening for the attachment to the dolls body. Lastly, turn this completed section right side out, and it is ready for attachment to bodies 100, 200, 300, and 500 shown in FIGS. 1 and 3–4.

Figure 11:
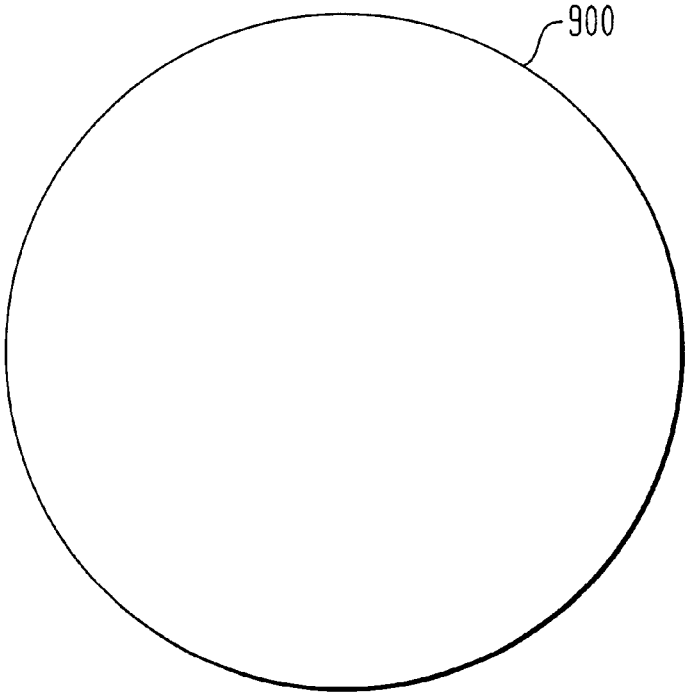

The following describes a method for fabricating a faceplate to be inserted into the recessed area of a doll or stuffed animal that is fabricated in accordance with the present invention. Referring to FIG. 11, cut one piece of fabric using faceplate pattern piece 900, the fabric is preferably 100% cotton.

Figure 12:
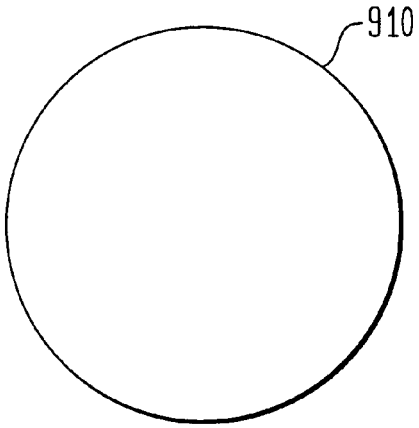
Figure 19:
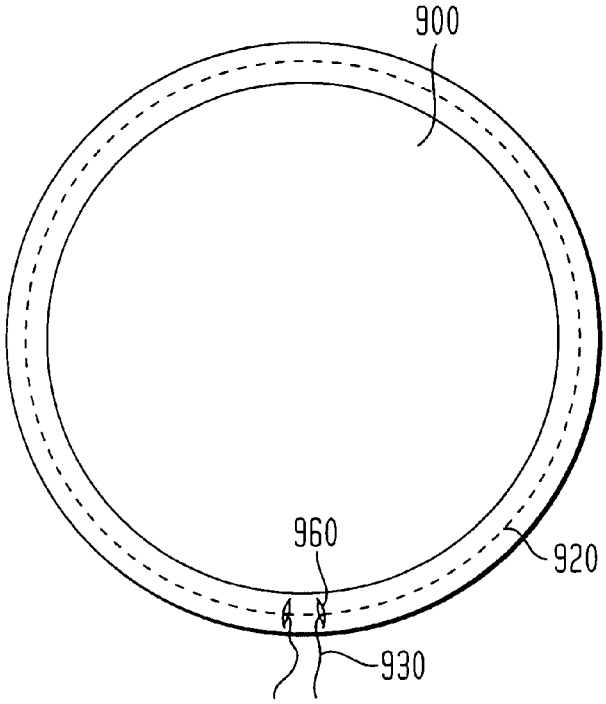

Next, referring to FIG. 12, cut one piece foam insert piece 910 from foam board, or other suitable hard material. Then, referring to FIG. 19, turn and stitch an approximately ½" hem around the outer edge of faceplate pattern piece 900, thereby making a tunnel around the outer edge. Next, as shown in FIG. 19, cut slit 960 in the tunneled hem, on the "wrong side" of the fabric and insert cord 930 into the tunneled hem while leaving about 4" of cord 930 hanging out of the tunnel hem on each side. Cord 930 will be used as a drawstring.

At this point, an image is applied or transferred to the "face side" of faceplate pattern piece 900 in accordance with any one of many methods that are well known to those of ordinary skill in the art. Doing so at this point in the fabrication process enables one to have a flat surface upon which to transfer the image.

Figure 20:
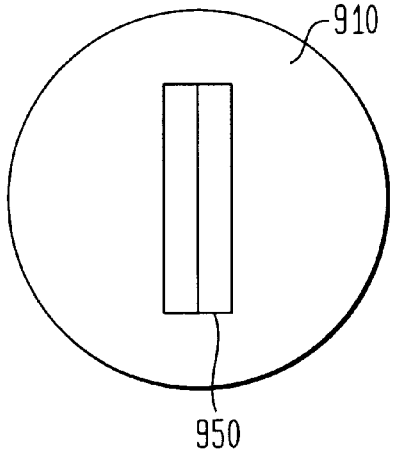
Figure 21:
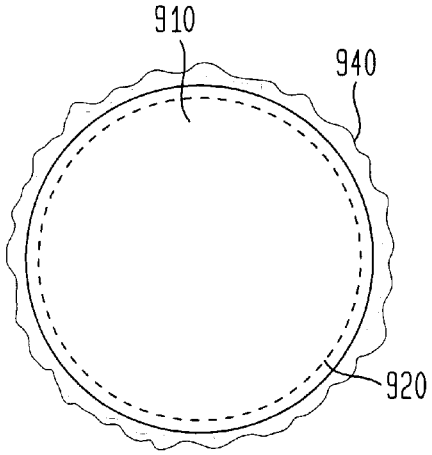
Figure 22:
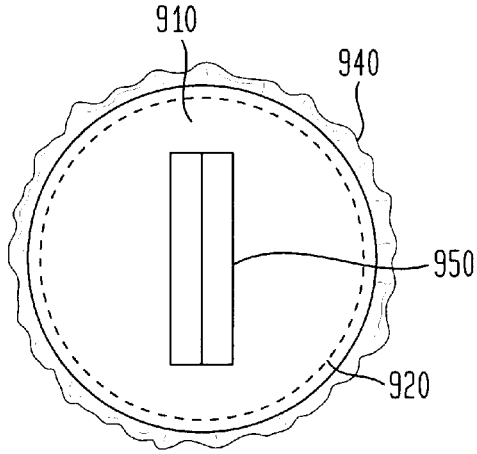

Next, referring to FIG. 20, glue or attach in any desired manner, two strips of Velcro 950 to the back side of foam insert piece 910. Next, referring to FIG. 21, cut a piece of batting 940 the size of foam insert piece 910 and attach batting 940 to the front of foam insert piece 910 by stitching around the outer edge. Advantageously, this gives the image a three-dimensional effect and provides padding to the faceplate. FIG. 22 shows the back side of the appliance shown in FIG. 21.

Figure 23:
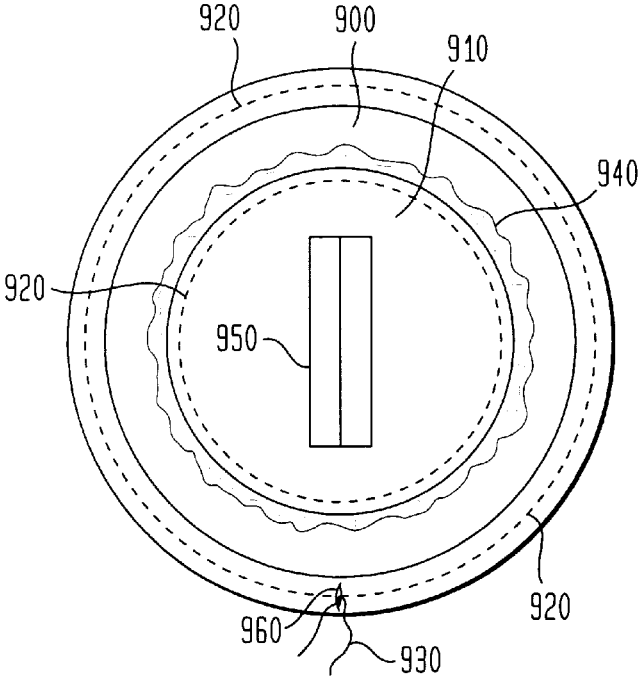

Next, referring to FIG. 23, place faceplate pattern piece 900 on a flat surface with the image face down. Place foam insert piece 910 "face side" down (with the Velcro(950) facing up) in the center of faceplate pattern piece 900. Then, applying pressure to the center of foam insert piece 910, for example, with one's hand, pull cord 930 to evenly make a pocket around foam insert piece 910.

Figure 24:
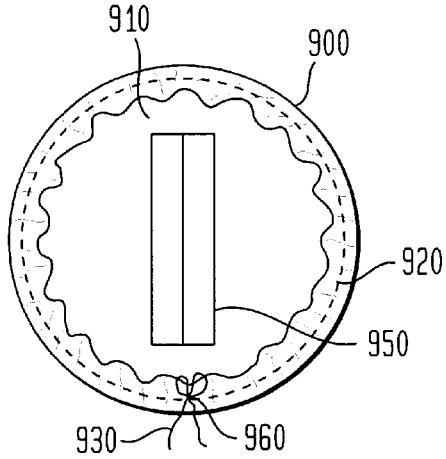

Lastly, referring to FIG. 24, tie the ends of cord 930. Then, clip and tuck them into the back area. At this point, the faceplate appliance is ready for insertion into the recessed area of a doll, a stuffed animal, or a novelty item.

Those skilled in the art will recognize that the foregoing description has been presented for the sake of illustration and description only. As such, it is not intended to be exhaustive or to limit the invention to the precise form disclosed. For example, the novelty items include purses, tote bags, pillows, wall plaques, and the like.

What is claimed is:

1. A doll which comprises:

a body;

a head attached to the body having a recessed area within the head, the head comprised of stuffing and a covering which acts to maintain the stuffing in place in the recessed area;

a substantially rigid receiver which comprises a stiffener covered by a material that acts: (a) to stand away from the face of the doll and (b) to establish an opening in the head, which receiver at least partially surrounds the recessed area; and a face appliance to be inserted into the recessed area, one side of which face appliance comprises a sheet having an indicium of a face, the face appliance having a perimeter with a shape similar to the opening established by the receiver, the shape being oval or round.

2. The doll of claim 1 wherein fastening mechanisms are affixed to the covering in the recessed area and fastening mechanisms are affixed to a side of the appliance opposite the side having an indicium of a face.

3. The doll of claim 2 wherein the fastening mechanisms are detachable fastening mechanisms.

4. The doll of claim 1 wherein the indicium of a face comprises an photographic image.

5. The doll of claim 4 wherein the photographic image is imprinted.

6. The doll of claim 1 wherein the material covering the stiffener also covers at least a portion of the head.

7. The doll of claim 1 wherein the substantially rigid receiver surrounds an area that is smaller than a cross sectional area of the face appliance.

8. The doll of claim 1 wherein the stiffener is formed of one or more of plastic, wood, metal, and rubber.

9. The doll of claim 1 wherein a surface of the recessed area is substantially flat and a side of the appliance opposite the side with a sheet having an indicium of a face is substantially flat.

10. The doll of claim 9 wherein the side of the appliance with a sheet having an indicium of a face is shaped.

* * * * *